US005441030A

United States Patent [19]

Satsukawa

[11] Patent Number: 5,441,030

[45] Date of Patent: Aug. 15, 1995

[54] FUEL INJECTION SYSTEM FOR TWO-STROKE CYCLE ENGINE

[76] Inventor: Ryuji Satsukawa, 1188-19 Sodeshi-cho, Shimizu-shi, Shizuoka-ken, Japan

[21] Appl. No.: 189,787

[22] Filed: Feb. 1, 1994

[51] Int. Cl.[6] ..... F02D 41/06

[52] U.S. Cl. ..... 123/491; 123/73 A; 123/478

[58] Field of Search ..... 123/73 A, 73 B, 73 C, 123/74 A, 478, 491

[56] References Cited

U.S. PATENT DOCUMENTS 4,960,097 10/1990 Tachibana et al. ..... 123/73 A X
5,050,559 9/1991 Kurosu et al. ..... 123/73 A X
5,191,531 3/1993 Kurosu et al. ..... 123/73 C X

FOREIGN PATENT DOCUMENTS 175121 7/1991 Japan .
175123 7/1991 Japan .

*Primary Examiner*—Tony M. Argenbright

[57] ABSTRACT

A fuel injection system for a two-stroke cycle engine capable of keeping an air-fuel ratio of an air-fuel mixture for combustion at a low engine speed optimum to improve startability of the engine in a cold district. The system includes a low-speed basic injection time increment setting unit for setting a low-speed basic injection time increment Tfi depending on an engine speed N and a throttle opening $\alpha$, a low-speed crankcase temperature correction factor setting unit for setting a low-speed crankcase temperature correction factor KLc, time correction factor setting units for setting a time correction factor Kt which is decreased with an increase in crankcase temperature, as well as with lapse of time, and a low-speed injection time increment setting unit for setting a low-speed injection time increment TiL by multiplying the increment Tfi by the correction factors KLc and Kt. A fuel injection time setting unit is arranged so as to add the increment TiL to basic fuel injection time Tp to provide injection time Tp+TiL, which is then corrected depending on various conditions to operate fuel injection time Ti.

5 Claims, 3 Drawing Sheets

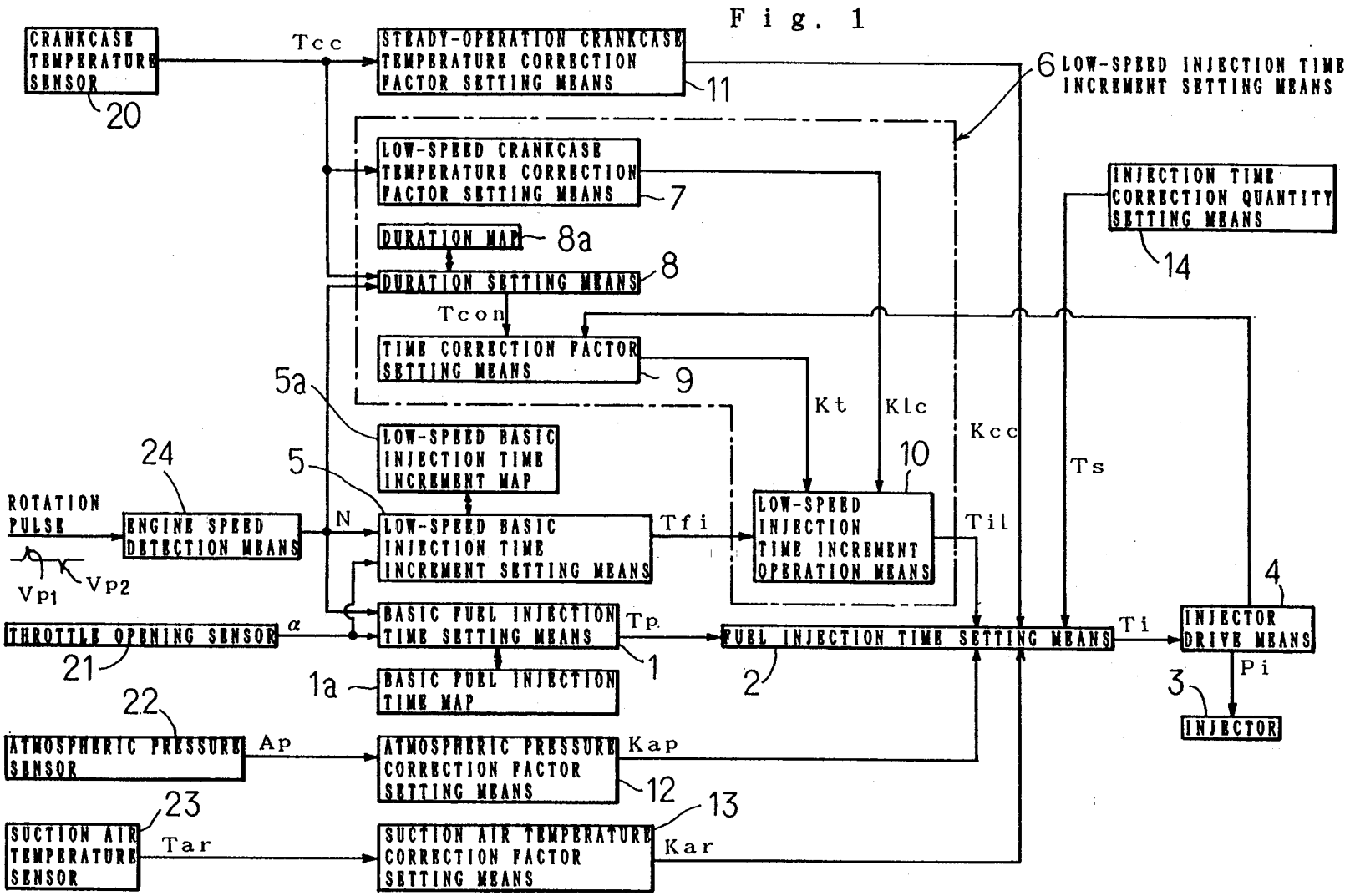
Fig. 1
LOW-SPEED INJECTION TIME INCREMENT SETTING MEANS
INJECTION TIME CORRECTION QUANTITY SETTING MEANS
INJECTOR DRIVE MEANS
INJECTOR
FUEL INJECTION TIME SETTING MEANS
LOW-SPEED INJECTION TIME INCREMENT OPERATION MEANS
STEADY-OPERATION CRANKCASE TEMPERATURE CORRECTION FACTOR SETTING MEANS
LOW-SPEED CRANKCASE TEMPERATURE CORRECTION FACTOR SETTING MEANS
DURATION MAP
DURATION SETTING MEANS
TIME CORRECTION FACTOR SETTING MEANS
LOW-SPEED BASIC INJECTION TIME INCREMENT MAP
LOW-SPEED BASIC INJECTION TIME INCREMENT SETTING MEANS
BASIC FUEL INJECTION TIME SETTING MEANS
BASIC FUEL INJECTION TIME MAP
ATMOSPHERIC PRESSURE CORRECTION FACTOR SETTING MEANS
SUCTION AIR TEMPERATURE CORRECTION FACTOR SETTING MEANS
CRANKCASE TEMPERATURE SENSOR
ENGINE SPEED DETECTION MEANS
THROTTLE OPENING SENSOR
ATMOSPHERIC PRESSURE SENSOR
SUCTION AIR TEMPERATURE SENSOR
ROTATION PULSE
Tcc
Ts
Ti
Pi
Kcc
Klc
Kt
Til
Tfi
Tp
Kap
Kar
Tcon
N
α
Ap
Tar
Vp1
Vp2
1
1a
2
3
4
5
5a
6
7
8
8a
9
10
11
12
13
14
20
21
22
23
24

FUEL INJECTION SYSTEM FOR TWO-STROKE CYCLE ENGINE

BACKGROUND OF THE INVENTION

This invention relates to a fuel injection system, and more particularly to a fuel injection system for a two-stroke cycle engine.

Recently, a two-stroke cycle engine in which a computer is used for controlling a fuel injection system to keep driving thereof optimum has been extensively used in the art.

A fuel injection system conventionally used for the two-stroke cycle engine generally includes a fuel injection valve or injector provided at a suction passage of the engine, a fuel pomp for feeding the injector with fuel under a constant pressure and a control unit for controlling the injector depending on drive conditions, environmental conditions and the like. The injector includes, for example, a needle valve and an electromagnetic coil for driving the needle valve, wherein the needle valve is rendered open for a period of time during which the coil is kept fed with a drive signal. A pressure of fuel fed from the fuel pump to the injector is kept constant, so that the amount of fuel injected from the injection is proportional to a period of time during which the valve of the injector is kept open or the drive signal is kept fed to the coil. A fuel injection pulse of a rectangular waveform is generally used as the drive signal, so that controlling of a pulse width (injection time) of the pulse permits the amount of fuel injected to be controlled.

The fuel injection system, when it is adapted to be controlled by a computer, generally includes a basic fuel injection time setting means for setting basic fuel injection time Tp using both an engine speed N operated on the basis of on intervals of generation of pulse signals from a signal generator mounted on the engine and a degree of opening of a throttle (hereinafter referred to "throttle opening") $\alpha$ as a parameter; a fuel injection time setting means for setting fuel injection time Ti by correcting the basic fuel injection time Tp depending on control conditions such as a temperature of cooling water, an atmospheric pressure, a temperature of air sucked into the engine (hereinafter referred to as "suction air temperature") and the like; and an injector drive means for feeding the injector with a fuel injection pulse Pi having a pulse width equal to the fuel injection time Ti set by the fuel injection time setting means.

The basic fuel injection time setting means is adapted to use a three-dimensional map which provides relationships among the engine speed, the throttle opening and the basic fuel injection time which is used as a base for the operation, wherein the three-dimensional map is retrieved while using, as a parameter, the engine speed N and the throttle opening $\alpha$ detected, resulting in the basic fuel injection time Ti at each of engine speeds being obtained directly or by interpolation from the map.

The fuel injection time setting means carries out the above-described operation for correcting the basic fuel injection time Tp depending on various control conditions including an atmospheric pressure, a suction air temperature, and the like, to thereby provide actual fuel injection time at each of engine speeds. The injector drive means starts to count a predetermined number of clock pulses, which are varied depending on the engine speed, at the time when the signal generator starts to generate a specific signal, to thereby obtain a predetermined injection timing, on the basis of which the injector is fed with the fuel injection pulse of a pulse width equal to the fuel injection time Ti.

The two-stroke cycle engine is constructed so as to feed an air-fuel mixture through a crankcase to a cylinder, so that an air-fuel ratio is affected by a temperature of the crankcase. In particular, when the two-stroke cycle engine is mounted on a vehicle used in a cool district such as a snowmobile, the crankcase is cooled to a very low temperature of −30° C. or less, so that a variation in crankcase temperature is extensively increased. Thus, control of a fuel injection rate depending on only a temperature of cooling water and the like without considering a crankcase temperature causes a failure in appropriate control of an air-fuel ratio, leading to deterioration in startability of the engine, particularly, at a low temperature.

In view of the above, a fuel injection system which is adapted to control of a fuel injection rate depending on a crankcase temperature is proposed, as taught in Japanese Patent Application Laid-Open Publication No. 175121/1991. More specificaliy, the fuel injection system proposed is so constructed that a basic fuel injection pulse width at a low engine speed (hereinafter referred to as "low-speed basic fuel injection pulse width") which is set on the basis of a crankcase temperature is corrected using a correction factor adapted to decrease the pulse width with lapse of time, to thereby set a fuel injection pulse width at a low engine speed (hereinafter referred to as "low-speed fuel injection pulse width") (injection time-at a low engine speed) and a basic fuel injection pulse width at a steady operation (hereinafter referred to as "steady operation basic fuel injection pulse width") is modified depending on various control conditions to set a fuel injection pulse width at a steady operation (hereinafter referred to as "steady-operation fuel injection pulse width"), so that the low-speed fuel injection pulse width and steady-operation fuel injection pulse widths are compared with each other, resulting in larger one of both pulse widths being employed as a pulse width of a fuel injection pulse fed to an injector.

In the proposed fuel injection system thus constructed, the low-speed fuel injection pulse width is set to be larger than the steady-operation fuel injection pulse width at the time when the engine is started. Therefore, a fuel injection pulse having a pulse width equal to the low-speed fuel injection pulse width is fed to the injector at the time of starting of the engine. This causes a fuel feed rate to be increased at the time of starting of the engine, to thereby facilitate starting of the engine. The low-speed fuel injection pulse width is decreased with lapse of time after starting of the engine, to thereby cause the steady-operation fuel injection pulse width to be increased as compared with the low-speed fuel injection pulse width in due course. Thus, the fuel injection pulse of a pulse width equal to the steady-operation fuel injection pulse width is caused to be fed to the injector in a predetermined period of time after starting of the engine or upon-completion of warming-up of the engine resulting in the fuel injection system being shifted to control for steady operation.

The conventional fuel injection system constructed as described above is adapted to determine the low-speed basic fuel injection pulse width based on only the crankcase temperature on the assumption that operation of an accelerator is not carried out at the time of starting and/or warming-up of the engine; so that during the warming-up in which the low-speed fuel injection pulse width is increased as compared with the steady-operation fuel injection pulse width, a fuel injection pulse width is set irrespective of a suction rate of air.

Thus, when the accelerator of the engine is operated at the time of starting and/or warming-up of the engine, an air-fuel ratio is caused to be deviated from an optimum value, resulting in starting of the engine being failed or rotation of the engine being unstable, leading to occurrence of engine stall.

SUMMARY OF THE INVENTION

The present invention has been made in view of the foregoing disadvantage of the prior art.

Accordingly, it is an object of the present invention to provide a fuel injection system for a two-stroke cycle engine which is capable of setting fuel injection time in view of a suction rate of air even at a low engine speed to improve startability of the engine and stabilize rotation of the engine, to thereby ensure smooth operation of the engine.

In accordance with the present invention, a fuel injection system for a two-stroke cycle engine is provided which includes a basic fuel injection time setting means for setting basic fuel injection time Tp using an engine speed N of the two-stroke cycle engine and a throttle opening $\alpha$, a fuel injection time setting means for correcting the basic fuel injection time Tp depending on various conditions to set fuel injection time Ti, and an injector drive means for feeding an injector with a fuel injection pulse Pi of a pulse width equal to the fuel injection time Ti set by the fuel injection time setting means.

One of features of the present invention generally constructed as described above is in that it further includes a basic injection time increment setting means at a low engine speed (hereinafter referred to as "low-speed basic injection time increment setting means") for setting a basic injection time increment at a low engine speed (hereinafter referred to as "low-speed basic injection time increment") Tfi corresponding to an increment of the fuel injection time at a low engine speed depending on the engine speed N and throttle opening $\alpha$, and an injection time increment setting means at a low engine speed (hereinafter referred to as "low-speed injection time increment setting means") for multiplying the low-speed basic injection time increment Tfi by a predetermined correction factor obtained using a temperature Tcc of a crankcase of the engine and elapsed time t as a parameter, to thereby provide an injection time increment at a low engine speed (hereinafter referred to as "low-speed injection time increment") TiL which is decreased with an increase in crankcase temperature Tcc, as well as with the lapse of time, wherein the fuel injection time setting means further corrects injection time Tp+TiL obtained by adding the low-speed injection time increment TiL to the basic fuel injection time Tp depending on various conditions, to thereby subject the fuel injection time Ti to an operation.

The elapsed time may be started at any fixed time. For example, it may be started at the time when the first injection pulse is output from the injector drive means after starting of the engine. In this instance, the low-speed injection time increment setting means may include a crankcase temperature correction factor setting means at a low engine speed (hereinafter referred to as "low-speed crankcase temperature correction factor setting means") for setting a crankcase temperature correction factor at a low engine speed (hereinafter referred to as "low-speed crankcase temperature correction factor") KLc using the crankcase temperature Tcc as a parameter, a duration setting means for setting duration of injection rate increment control at a low engine speed (hereinafter referred to as "low-speed injection rate increment control duration") Tcon using the engine speed N or throttle opening $\alpha$ and the crankcase temperature Tcc as a parameter, a time correction factor setting means for measuring the elapsed time t starting at the time when the first fuel injection pulse is output from the injector drive means, to thereby provide a time correction factor $Kt=1-(t/Tcon)$ based on the elapsed time t measured and the duration Tcon, and a means for operating an injection time increment at a low engine speed (hereinafter referred to as "low-speed injection time increment operation means") which carries out an operation $Tfi \times KLc \times Kt$ of multiplying the low-speed basic injection time increment Tfi by the low-speed crankcase temperature correction factor KLc and time correction factor Kt to provide a result of the operation as an injection time increment at a low engine speed (hereinafter referred to as "low-speed injection time increment") TiL.

Alternatively, the elapsed time may be started at time when the first ignition spark is emitted for the engine or at the time when a starter for the engine is activated.

In a preferred embodiment of the present invention, the fuel injection system may further includes a crankcase temperature correction factor setting means at a steady operation (hereinafter referred to as "steady-operation crankcase temperature correction factor setting means") for setting a crankcase temperature correction factor at a steady operation (hereinafter referred to as "steady-operation crankcase temperature correction factor") Kcc using the crankcase temperature Tcc as a parameter, an atmospheric pressure correction factor setting means for setting an atmospheric pressure correction factor Kap using an atmospheric pressure detected by an atmospheric pressure sensor as a parameter, and a suction air temperature correction factor setting means for setting a suction air temperature correction factor Kar using a suction air temperature Tar of the engine detected by a suction air sensor as a parameter, wherein the fuel injection time setting means carries out an operation $(Tp+TiL) \times Kar \times Kcc \times Kap$ to provide a result of the operation as the fuel injection time Ti.

In a preferred embodiment of the present invention, the fuel injection system may further include a means for setting the quantity of correction of injection time (hereinafter referred to as "injection time correction quantity setting means") 14 which functions to detect a power supply voltage VB of the injector drive means to set the quantity of correction of injection time (hereinafter referred to as "injection time correction quantity") Ts depending on the power supply voltage detected, wherein the fuel injection time setting means carries out an operation $(Tp+TiL) \times Kar \times Kcc \times Kap + Ts$ to provide a result of the operation as the fuel injection time Ti.

Alternatively, the injection time correction quantity setting means 14 may be constructed so as to set the injection time correction quantity Ts using a rotation speed of the engine as the parameter.

In the present invention constructed as described above, the low-speed basic injection time increment Tfi set depending on the engine speed N and throttle opening $\alpha$ is multiplied by the predetermined correction factor obtained using the crankcase temperature Tcc and elapsed time t as a parameter, to thereby provide the low-speed injection time increment TiL which is decreased with an increase in crankcase temperature, as well as with lapse of time, and then the basic fuel injection time Tp is added to the thus obtained low-speed injection time increment TiL to obtain the injection time Tp+TiL, which is then subject to correction depending on various conditions to operate the fuel injection time Ti. Such construction permits the low-speed fuel injection time to be based on the throttle opening or a suction rate of air. This permits an air-fuel ratio, of an air-fuel mixture for combustion at a low engine speed to be kept at a suitable value, to thereby improve startability of the engine and stabilize rotation of the engine during the warming-up.

Also, the present invention permits the low-speed injection time increment to be decreased with an increase in crankcase temperature and with lapse of time, so that a period of time from starting of the engine to a steady operation thereof or warming-up time may be increased when the crankcase temperature is low and decreased when it is high. This permits the warming-up to be carried out for a period of time depending on the crankcase temperature, to thereby prevent useless or waste consumption of fuel.

BRIEF DESCRIPTION OF THE DRAWINGS

These and other objects and many of the attendant advantages of the present invention will be readily appreciated and becomes better understood by reference to the following detailed description when considered in connection with the accompanying drawings; wherein:

FIG. 1 is a block diagram generally showing an embodiment of a fuel injection system for a two-stroke cycle engine according to the present invention;

DETAILED DESCRIPTION OF THE PREFERRED EMBODIMENT

Figure 2:
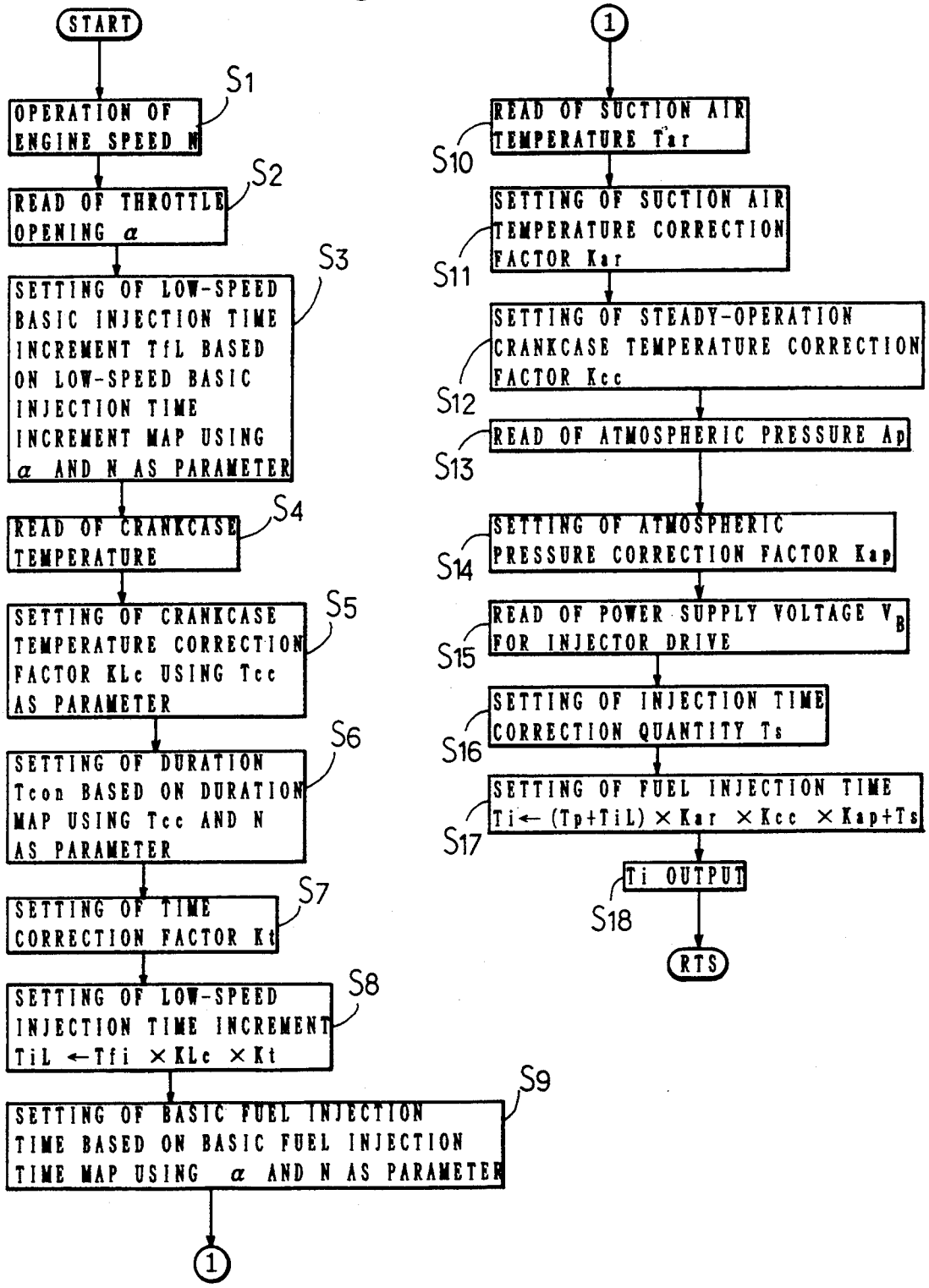
FIG. 2 is a flow chart showing algorithm of a program used for realizing various function realizing means by a computer.

Now, a fuel injection system for a two-stroke cycle engine according to the present invention will be described hereinafter with reference to the accompanying drawings.

Referring first to FIG. 1, an embodiment of a fuel injection system for a two-stroke cycle engine according to the present invention is generally illustrated, wherein reference numeral 20 designates a crankcase temperature sensor mounted on a crankcase of a two-stroke cycle engine, which sensor 20 functions to detect a crankcase temperature Tcc to generate an electric signal proportional to the temperature Tcc.

Reference numeral 21 designates a throttle opening sensor for detecting a throttle opening $\alpha$ of a throttle valve provided in an inlet manifold connected to an inlet port of the engine. The sensor may comprise a potentiometer adapted to be operated in association with pivotal movement of the throttle valve and is adapted to generate an electric signal proportional to the throttle opening $\alpha$.

The fuel injection system of the illustrated embodiment also includes an atmospheric pressure sensor 22 for detecting an atmospheric pressure Ap and a suction air temperature sensor 23 for detecting a temperature of air (suction air) flowing into the inlet manifold (suction air) Tar. The suction air temperature sensor 23 is arranged at a suitable location on an upstream side of the inlet manifold such as, for example, a location between the inlet manifold and an air cleaner and generates an electric signal proportional to the suction air temperature Tar.

An output of each of the crankcase temperature sensor 20, throttle opening sensor 21, atmospheric pressure sensor 22 and suction air temperature sensor 23 is converted into a digital signal by an A/D converter, which is then inputted to a CPU of a microcomputer, followed by being stored in a RAM thereof.

Reference numeral 3 is an injector arranged on a downstream side of the inlet manifold defined on the basis of the throttle valve so as to eject fuel therefrom.

Also, in FIG. 1, reference numeral 24 designates engine speed detection means for detecting an engine speed N (rpm), which means 24 functions to operate the engine speed based on an output of a signal generator mounted on the engine. The signal generator may comprise, for example, a rotor constructed by forming a reluctor (a projection or a recess extending in a circumferential direction) on an outer periphery of a flywheel mounted on the engine and an electromagnetic pickup arranged opposite to the rotor, wherein a variation in magnetic flux occurs in the electromagnetic pickup when the reluctor starts to be opposite to a magnetic pole of the electromagnetic pickup and when the oppositeness terminates, resulting in the electromagnetic pickup generating pulse-like signals (rotation pulses) Vp1 and Vp2 different in polarity from each other. The engine speed detection means 24 measures a period of time Tpd extending from generation of the signal Vp1 to generation of the signal Vp2 (time required for the reluctor to pass through the electromagnetic pickup), to thereby operate the engine speed N based on the time Tpd measured and an angle forming an arc of a magnetic pole (hereinafter referred to "polar arc angle") $\Theta$ of the reluctor according to the following expression (1):

$$N=\Theta/(6\times Tpd) \quad (1)$$

The engine speed detection means 24 described above may be realized by the microcomputer.

Reference numeral 1 is a basic fuel injection time setting means, which functions to retrieve a basic fuel injection time map 1*a* using the throttle opening $\alpha$ detected by the throttle opening sensor 21 and the engine speed N (rpm) detected by the engine speed detection means 24 as a parameter to provide basic fuel injection time Tp depending on the throttle opening $\alpha$ and engine speed N directly or by interpolation from the map 1*a*. The basic fuel injection time Tp constitutes a base for an operation of steady-operation fuel injection time. More specifically, the steady-operation fuel injection time is obtained by multiplying the basic fuel injection time by a predetermined correction factor or adding correction time to the basic fuel injection time.

The basic fuel injection time map 1*a* is a three-dimensional map which provides relationships between the throttle opening $\alpha$ and engine speed N and the basic fuel injection time Tp. Data for defining the map are obtained by an experiment for every engine speed and stored in a ROM of the microcomputer.

The fuel injection system of the illustrated embodiment also includes a low-speed basic injection basic injection time increment setting means 5, which is adapted to retrieve a low-speed basic fuel injection time increment map 5*a* using the engine speed N and throttle opening $\alpha$ as a parameter to provide a low-speed basic fuel injection time increment Tfi depending on the throttle opening $\alpha$ and engine speed N (rpm) directly or by interpolation from the map 5*a*. The map 5*a* is a three-dimensional map which provides relationships between throttle opening $\alpha$, engine speed N and low-speed basic fuel injection time increment Tfi. Data for defining the map are previously obtained by an experiment or the like and stored in the ROM of the microcomputer.

The low-speed basic injection time increment Tfi constitutes a base for an operation for obtaining a low-speed fuel injection time increment and is decreased with an increase in engine speed. Relationships between the low-speed basic injection time increment Tfi and the throttle opening $\alpha$ are varied depending on the amount of adhesion of fuel to an inner surface of an inlet system, load characteristics of the engine and the like. Such relationships include not only a simple relationship that the increment is varied with a decrease or increase in throttle opening, but a relationship that the increment Tfi is decreased with an increase in throttle opening within a range wherein the throttle opening is increased to a predetermined angle and increased with an increase in throttle opening within a range wherein the throttle opening exceeds the angle $\Theta$s. The latter relationship depends on characteristics of the engine. The low-speed fuel injection time increment described above is obtained by the low-speed basic injection time increment Tfi by a predetermined correction factor.

The fuel injection system of the illustrated embodiment further includes a low-speed injection time increment setting means 6, which includes a low-speed crankcase temperature correction factor setting means 7, a duration setting means 8, a time correction factor setting means 9 and a low-speed injection time increment operation means 10.

The low-speed crankcase temperature correction factor setting means 7 functions to set a low-speed crankcase temperature. correction factor KLc using the crankcase temperature Tcc as a parameter. Setting of the correction factor KLc may be carried out by a map prepared on the basis of data obtained by an experiment or the like. Alternatively, it may be made using an operation expression obtained from results of an experiment or the like.

The duration setting means 8 retrieves a duration map 8*a* using the engine speed N and crankcase temperature Tcc as a parameter to obtain low-speed injection quantity increment control duration Tcon directly or by interpolation from the map 8*a*. The duration map 8*a* is a three-dimensional map which provides relationships among the engine speed N, crankcase temperature Tcc and duration Tcon, and data for defining the map 8*a* which are previously obtained by an experiment are stored in the R0M of the microcomputer. The duration Tcon is decreased with an increase in crankcase temperature Tcc, as well as with an increase in engine speed N. More specifically, the more the crankcase temperature during warming-up of the engine is increased, the more the duration (warming-up time) Tcon is reduced; whereas the more the engine speed during the warming-up is increase, the more the duration Tcon is reduced.

When fuel is injected from the injector into the inlet system of the engine for feeding thereto, the amount of fuel adhered to an inner surface of the inlet system or, in the illustrated embodiment, the inner surface of the inlet manifold, is varied depending on a suction rate of air, and the amount of fuel adhered to of the inner surface of the inlet system affects a suction rate of air introduced into a combustion chamber. More particularly, a decrease in suction rate of air causes the amount of fuel adhered to the inner surface of the inlet system or, in the illustrated embodiment, the inner surface of the inlet manifold to be increased; whereas an increase in suction rate of air causes the amount of fuel adhered to the inner surface of the inlet system to be decreased and a part of fuel already adhered to the inner surface to be introduced in the form of droplets into the combustion chamber, so that the amount of fuel introduced into the combustion chamber may be increased with a suction rate of air. Thus, in the illustrated embodiment, the injection rate increment control duration Tcon is reduced with an increased in engine speed.

Also, in the illustrated embodiment, the duration Tcon is set using the engine speed N and crankcase temperature Tcc as a parameter, as described above. Alternatively, the throttle opening $\alpha$ and crankcase temperature Tcc may be used as the parameter. In this instance, an increase in crankcase temperature reduces the duration or warming-up time Tcon and an increase in throttle opening $\alpha$ leads to a decrease in duration.

Figure 3:
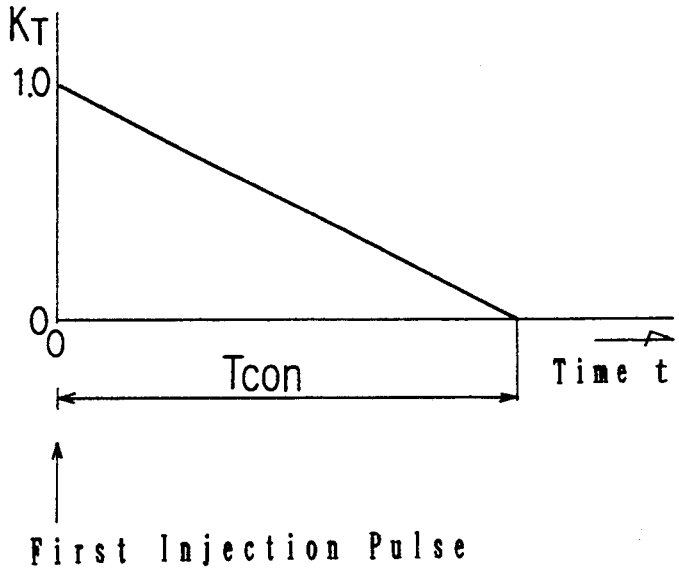
FIG. 3 is a diagrammatic view showing an example of a change of a time correction factor to elapsed time in the embodiment shown in FIG. 1.

The time correction factor setting means 9 includes a timer means for measuring elapsed time t starting at the time when the first fuel injection pulse is generated from an injector drive means 4 and an operation means for operating a time correction factor $Kt=1-(t/Tcon)$ based on the elapsed time t measured by the timer means and the duration Tcon. The time correction factor Kt, as shown in FIG. 3, reaches a value of 1.0 at the time when the first injection pulse is generated and then linearly decreased with time, resulting in reaching a value of 0 when the duration Tcon elapses.

The low-speed injection time increment operation means 10 carries out an operation $Tfi \times KLc \times Kt$ of multiplying the low-speed basic injection time increment Tfi by the low-speed crankcase temperature correction factor KLc and time correction factor Kt to provide a result of the operation as a low-speed injection time increment TiL.

The fuel injection system of the illustrated embodiment. also includes an atmospheric pressure correction factor setting means 12, which functions to carry out the operation or retrieval of the map based on an atmospheric pressure Ap detected by the atmospheric pressure sensor 22 to provide an atmospheric pressure correction factor Kap, The atmospheric pressure correction factor Kap thus obtained is increased when the atmospheric pressure is high and decreased when it is low.

Reference numeral 13 is a suction air temperature correction factor setting means, which functions to provide a suction air temperature correction factor Kar based on the suction air temperature Tar detected by the suction air temperature sensor 23. The suction air temperature correction factor Kar is decreased and increased when the suction air temperature is increased and decreased, respectively.

The fuel injection system of the illustrated embodiment further includes an injection time correction quantity setting means 14, which serves to detect a power supply voltage $V_B$ of the injector drive means 4, to thereby set an injection time correction quantity Ts depending on the power supply voltage detected. The injection time correction quantity Ts thus set by the injection time correction quantity setting means 14 is then fed to a fuel injection time setting means 2.

The fuel injection time setting means 2 operates fuel injection time Ti according to the following operation expression (2) to feed data on the thus operated fuel injection time Ti to the injector drive means 4:

$$Ti=(Tp+TiL)\times Kar\times Kcc\times Kap+Ts \quad (2)$$

The injector drive means 4 functions to operate, for each of the engine speeds, injection timing measuring time which is a period of time between time at which the signal generator mounted on the engine generates a specific signal such as, for example, the pulse-like signal $V_p2$ and ignition start time, so that measuring of the injection timing measuring time is started every time when the specific signal is generated and when measuring of the injection timing measuring time is terminated, a switching element such as a transistor or the like is fed with a fuel injection pulse Pi of a pulse width equal to the injection time Ti. The switching element is kept conductive for a period of time during which it is kept fed with the fuel injection pulse Pi, to thereby permit the power supply voltage to be applied to a drive coil of the injector 3. When a predetermined drive current flows after the power supply voltage is applied to the injector, a valve of the injector is rendered open for injection of fuel.

In general, a decrease in voltage of the power supply for driving the injector causes rising of a drive voltage of the injector to tend to be delayed, so that the actual injection time is decreased as compared with the pulse width of the fuel injection pulse Pi. In view of the above, the illustrated embodiment is constructed so as to detect the power supply voltage for driving the injector to carry out addition of the injection time correction quantity Ts appropriately determined depending on the power supply voltage, to thereby correct a variation in injection time due to a variation in power supply voltage.

The valve of the injector 3 is kept open while it is kept fed with the fuel injection pulse Pi, so that fuel may be injected into the inlet manifold.

FIG. 2 shows a routine which the computer executes at every rotation of the engine for controlling the fuel injection, which routine is executed every time when the signal generator mounted on the engine generates the specific signal described above.

When the signal generator generates the specific signal such as, for example, the signal Vp1, a step S1 is first executed. In the step S1, the engine speed N is operated according to the above-described operation expression (1) based on the polar arc angle Θ of the reluctor of the signal generator and intervals of generation of the signals Vp1 and Vp2 and a result of the operation is stored in the RAM of the microcomputer. The step S1 permits the engine speed detection means 24 to be realized.

In a step S2, read of the throttle opening $\alpha$ provided by the throttle opening sensor is carried out. Then, a step S3 is executed to retrieve the low-speed basic injection time increment map using the throttle opening $\alpha$ and the engine speed already operated as a parameter or carry out read directly or by interpolation from the map, to thereby set the low-speed basic injection time increment Tfi, which is then stored in the RAM of the microcomputer. The steps S2 and S3 lead to realization of the low-speed basic injection increment setting means.

In a step S4 subsequent to the step S3, read of the crankcase temperature Tcc is executed. Then, in the next step S5, retrieval of the map or the operation is carried out using the crankcase temperature Tcc as a parameter to set the low-speed crankcase temperature correction factor KLc, which is then stored in the RAM of the microcomputer. Thus, the steps S4 and S5 permit realization of the low-speed crankcase temperature correction factor setting means 7.

Then, a step S6 is executed to retrieve the duration map using the crankcase temperature Tcc and engine speed N as a parameter, to thereby operate the duration Tcon, and a result of the operation is stored in the RAM. The step S6 leads to realization of the duration setting means 8.

A step S7 is executed to operate the time correction factor Kt according to the above-described operation expression (2) based on the duration Tcon and the elapsed time t starting at the time when the first injection pulse is generated, and a result of the operation is stored in the RAM. The step S7 permits realization of the time correction factor setting means 9.

The next step S8 is executed to read the low-speed basic injection time increment Tfi already set and stored in the RAM, the crankcase temperature correction factor KLc, and the time correction factor Kt to carry out an operation according to the following operation expression (3):

$$TiL=Tfi\times KLc\times Kt \quad (3)$$

and a result of the operation is stored in the RAM. The step S8 permits the low-speed injection time increment operation means 10 to be realized.

A step S9 is then executed to retrieve the basic fuel injection time map using the throttle opening $\alpha$ and engine speed N as a parameter to obtain the basic fuel injection time Tp, which is then stored in the RAM. Thus, the step S9 permits the basic fuel injection time setting means 1 to be realized.

After the basic fuel injection time Tp is thus set, a step S10 is executed to carry out read of the suction air temperature Tar and then a step S 11 is executed to set the suction air temperature correction factor Kar, which is then stored in the RAM. Such setting of the correction factor Kar is carried out through retrieval of the map or the operation expression. Thus, the steps S10 and S11 lead to realization of the suction air temperature correction factor setting means 13.

Subsequently, a step S12 is executed to carry out read of the crankcase temperature Tcc and retrieval of the map or the operation, to thereby set the steady-operation crankcase temperature correction factor Kcc, Thus, the step S12 permits the steady-operation crankcase temperature correction factor setting means 11 to be realized.

A step S13 next to the step 12 is executed to carry out read of the atmospheric pressure Ap provided by the atmospheric pressure sensor and then a step S14 carries out retrieval of the map or the operation to set the atmospheric pressure correction factor Kap, which is then stored in the RAM. The steps S13 and S14 lead to realization of the atmospheric pressure correction factor setting means 12.

A step S15 is executed to read the power supply voltage $V_B$ of the injector drive means and then a step S16 is practiced to set the injection time correction quantity Ts by retrieval of the map or the operation. The steps S15 and S16 result in the injection time correction quantity setting means 14 being realized.

The subsequent step S17 is executed to read out the basic fuel injection time Tp already set, low-speed injection time increment TiL, suction air temperature correction factor Kar, crankcase temperature correction factor Kcc, atmospheric pressure correction factor Kap and injection time correction quantity Ts from the RAM, to thereby operate the fuel injection time Ti according to the above-described operation expression (2). The step S17 leads to realization of the fuel injection time setting means 2.

A step S18 is practiced to start measuring the injection timing measuring time already operated in a main routine when the signal generator generates the specific signal such as, for example, the signal Vp2 and then feed the fuel injection pulse Pi of a pulse width equal to the fuel injection time Ti to a control terminal of the switching element which functions to switch feeding of electricity to the injector. The switching element is rendered conductive when the fuel injection pulse Pi is fed thereto, resulting in the power supply voltage being applied to the injector. This leads to flowing of a drive current through the injector. The valve of the injector is kept open to inject fuel for a period of time during which the drive current of a predetermined operation level or more is kept flowing through the injector. After the fuel injection pulse Pi is generated, the routine is returned to the start.

Figure 4:
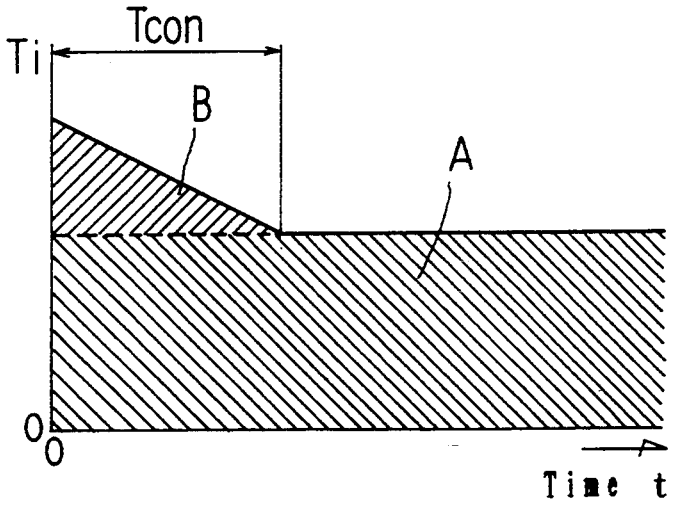
FIG. 4 is a diagrammatic view showing an example of a change of fuel injection time to elapsed time in the embodiment shown in FIG. 1.

FIG. 4 shows one example of a variation in fuel injection time Ti with time, wherein a region A of oblique lines extending from upper left to lower right indicates the steady-operation injection time ($=Tp\times Kar\times Kcc\times Kap+Ts$), whereas a region B of oblique lines extending upper right to lower left indicates the injection time increment ($=TiL\times Kar\times Kcc\times Kap$) added to the injection time Tp at a low engine speed.

In the embodiment described above, an order of execution of the steps S1 to S18 shown in FIG. 2 may be varied as desired. For example, the step S9 may be executed in advance of the step S3.

Such arrangement of the injection time correction quantity setting means 14 as in the illustrated embodiment substantially prevents a variation in fuel injection time to a variation in power supply voltage. However, arrangement of the means 14 may be eliminated when the power supply voltage is not varied. Also, the illustrated embodiment is adapted to provide the correction factor using the suction air temperature and atmospheric pressure in addition to the crankcase temperature as the control conditions. Alternatively, any other factors may be added to the control conditions as desired.

As can be seen from the foregoing, the present invention is so constructed that the low-speed basic injection time increment Tfi set depending on the engine speed N and throttle opening$\alpha$ is multiplied by the predetermined correction factor obtained using the crankcase temperature Tcc and elapsed time t as a parameter, to thereby provide the low-speed injection time increment TiL which is decreased with an increase in crankcase temperature, as well as with lapse of time, and then the basic fuel injection time Tp is added to the thus obtained low-speed injection time increment TiL to obtain the injection time Tp+TiL, which is then subject to correction depending on various conditions to operate the fuel injection time Ti. Such construction permits the low-speed fuel injection time to be based on the throttle opening or a suction rate of air. This permits an air-fuel ratio of an air-fuel mixture for combustion at a low engine speed to be kept at a suitable value, to thereby improve startability of the engine and stabilize rotation of the engine during the warming-up.

Also, the present invention permits the low-speed injection time increment to be decreased with an increase in crankcase temperature and with lapse of time, so that a period of time from starting of the engine to a steady operation thereof or warming-up time may be increased when the crankcase temperature is low and decreased when it is high. This permits the warming up to be carried out for a period of time depending on the crankcase temperature, to thereby prevent useless or waste consumption of fuel.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fuel injection system for a two-stroke cycle engine, comprising:

a basic fuel injection time setting means for setting basic fuel injection time Tp using an engine speed N of the two-stroke cycle engine and a throttle opening $\alpha$;

a fuel injection time setting means for correcting said basic fuel injection time Tp depending on various conditions to set fuel injection time Ti;

an injector drive means for feeding an injector with a fuel injection pulse Pi of a pulse width equal to said fuel injection time Ti set by said fuel injection time setting means;

a low-speed basic injection time increment setting means for setting a low-speed basic injection time increment Tfi corresponding to an increment of the fuel injection time at a low engine speed depending on said engine speed N and throttle opening $\alpha$; and a low-speed injection time increment setting means for multiplying said low-speed basic injection time increment Tfi by a predetermined correction factor obtained using a temperature Tcc of a crankcase of the engine and elapsed time t as a parameter, to thereby provide a low-speed injection time increment TiL which is decreased with an increase in crankcase temperature Tcc, as well as with the lapse of time;

said fuel injection time setting means further correcting injection time Tp+TiL, obtained by adding said low-speed injection time increment TiL to said basic fuel injection time Tp, depending on various conditions, to thereby subject said fuel injection time Ti to an operation.

2. A fuel injection system as defined in claim 1, wherein said low-speed injection time increment setting means comprises:

a low-speed crankcase temperature correction factor setting means for setting a low-speed crankcase temperature correction factor KLc using said crankcase temperature Tcc as a parameter;

a duration setting means for setting low-speed injection rate increment control duration Tcon using said engine speed N or throttle opening $\alpha$ and said crankcase temperature Tcc as a parameter;

a time correction factor setting means for measuring the elapsed time t starting at the time when the first fuel injection pulse is outputted from said injector drive means, to thereby provide a time correction factor $Kt=1-(t/Tcon)$ based on the elapsed time t measured and said duration Tcon; and a low-speed injection time increment operation means which carries out an operation $Tfi \times KLc \times Kt$ of multiplying said low-speed basic injection time increment Tfi by said low-speed crankcase temperature correction factor KLc and time correction factor Kt to provide a result of the operation as a low-speed injection time increment TiL.

3. A fuel injection system as defined in claim 1 or 2, further comprising a steady-operation crankcase temperature correction factor setting means for setting a steady-operation crankcase temperature correction factor Kcc using said crankcase temperature Tcc as a parameter;

an atmospheric pressure correction factor setting means for setting an atmospheric pressure correction factor Kap using, an atmospheric pressure detected by an atmospheric pressure sensor as a parameter; and a suction air temperature correction factor setting means for setting a suction air temperature correction factor Kar using a suction air temperature Tar of the engine detected by a suction air sensor as a parameter;

said fuel injection time setting means carrying out an operation $(Tp+TiL) \times Kar \times Kcc \times Kap$ to provide a result of the operation as said fuel injection time Ti.

4. A fuel injection system as defined in claim 3, further comprising an injection time correction quantity setting means which functions to detect a power supply voltage VB of said injector drive means to set an injection time correction quantity Ts depending on the power supply voltage detected;

said fuel injection time setting means carrying out an operation $(Tp+TiL) \times Kar \times Kcc \times Kap+Ts$ to provide a result of the operation as said fuel injection time Ti.

5. A fuel injection system as defined in claim 3, further comprising an injection time correction quantity setting means for setting an injection time correction quantity Ts using the engine speed as a parameter;

said fuel injection time setting means carrying out an operation $(Tp+TiL) \times Kar \times Kcc \times Kap+Ts$ to provide a result of the operation as said fuel injection time Ti.

* * * * *

UNITED STATES PATENT AND TRADEMARK OFFICE

CERTIFICATE OF CORRECTION

PATENT NO. : 5,441,030

DATED : August 15, 1995

INVENTOR(S) : Ryuji Satsukawa

It is certified that error appears in the above-indentified patent and that said Letters Patent is hereby corrected as shown below:

On the title page: Item [73] Assignee should read --Kokusan Denki Co., Ltd., Shizuoka-Ken, Japan --.

Item [57] Attorney, Agent, or Firm should read -- Pearne, Gordon, MCCoy & Granger --.

Column 2, line 63, "upon-completion" should read --upon completion--;

Column 2, line 64, after "engine" insert --,--.

Column 5, line 18, after "ratio" delete --,--.

Column 6, line 29, after "designates" insert --an--.

Column 7, line 38, after "angle" insert --Os--.

Column 7, line 54, after "temperature" delete --.--.

Column 8, line 58, after "ment" delete --.--.

Column 12, line 27, "warming up" should read --warming-up--.

Signed and Sealed this

Ninth Day of January, 1996

*Attest:*

*Attesting Officer*

BRUCE LEHMAN

*Commissioner of Patents and Trademarks*